US006216392B1

(12) United States Patent
DiGinosa

(10) Patent No.: US 6,216,392 B1
(45) Date of Patent: Apr. 17, 2001

(54) SLIDING WINDOW SEAL

(75) Inventor: Anthony V. DiGinosa, Mississauga (CA)

(73) Assignee: Royal Plastics Inc., Woodbridge ( * ) Notice: Subject to any disclaimer, the term of this patent is extended or adjusted under 35 U.S.C. 154(b) by 0 days.

(21) Appl. No.: 09/344,356

(22) Filed: Jun. 25, 1999

(30) Foreign Application Priority Data

Jun. 26, 1998 (CA) ..... 2241680

(51) Int. Cl.[7] ..... E05D 15/22; E05D 15/10
(52) U.S. Cl. ..... 49/183; 49/209; 49/213
(58) Field of Search ..... 49/209, 183, 212–214, 49/180, 181, 185, 176, 161, 453, 455, 463, 276–178

(56) References Cited

U.S. PATENT DOCUMENTS 3,810,332 * 5/1974 Grossman ..... 49/453 X
4,464,864 * 8/1984 Yackiw ..... 49/404
4,604,831 * 8/1986 Tunnicliffe et al. ..... 49/404 X
4,610,108 * 9/1986 Marshik ..... 49/453 X
4,976,066 * 12/1990 Plummer et al. ..... 49/219 X
5,159,794 * 11/1992 Habbersett et al. ..... 49/453 X
5,185,955 * 2/1993 Pedersen ..... 49/183 X
5,274,955 * 1/1994 Dallaire et al. ..... 49/458 X
5,371,971 * 12/1994 Prete ..... 49/181 X
5,619,822 * 4/1997 Trompert ..... 49/209
5,649,389 * 7/1997 Coddens ..... 49/176 X
5,675,948 * 10/1997 Boesch ..... 49/501 X
5,799,444 * 9/1998 Freimark et al. ..... 49/209 X

* cited by examiner

*Primary Examiner*—Daniel P. Stodola
*Assistant Examiner*—Hugh B. Thompson

(57) ABSTRACT

A window unit has a sliding sash which is moved latterly in the window frame as the sash is closed to compress weather stripping extending completely around the sash between the sash and a peripheral stop surface on the window frame. The sash is also tiltable as well as slidable.

11 Claims, 10 Drawing Sheets

17'
17a'
2
2'
8'
6'
12
8b'
16'
13
18
19
4
8a'
9

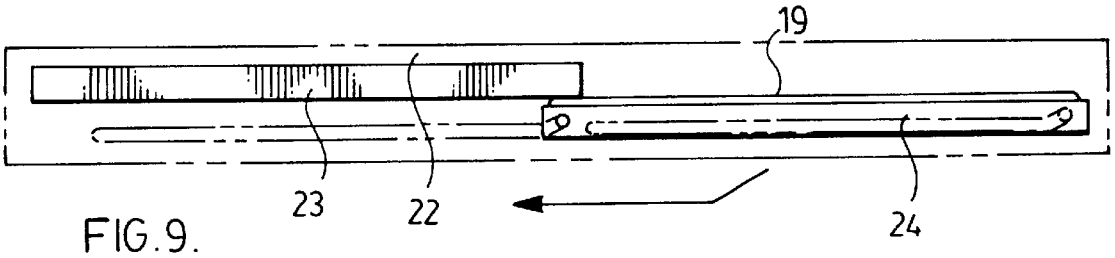
FIG.9.
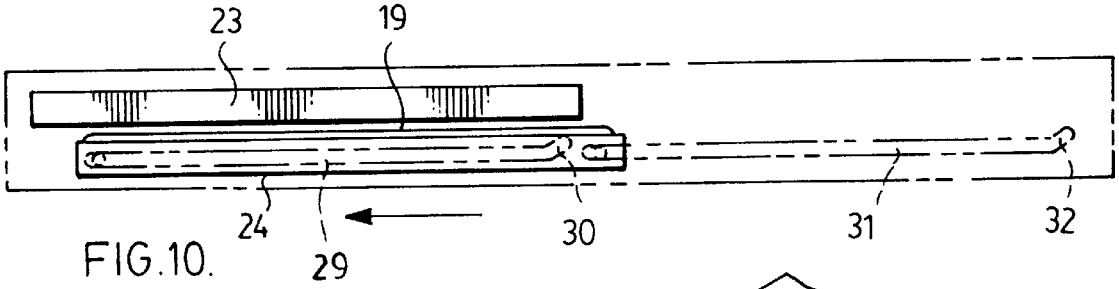
FIG.10.
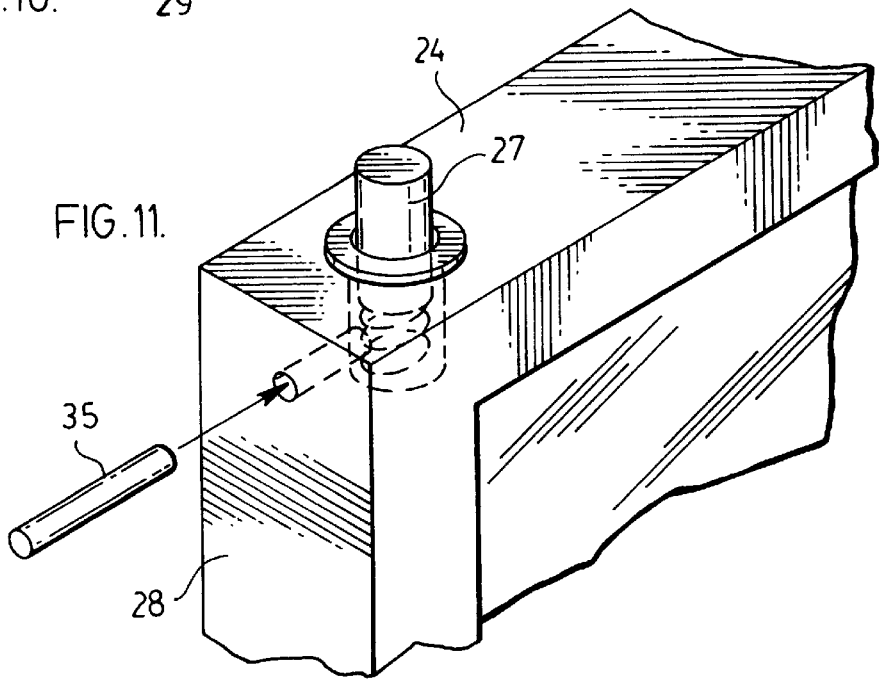
FIG.11.
FIG.12.
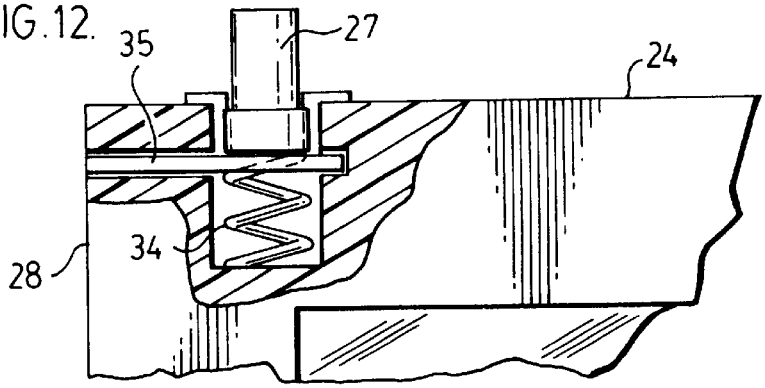

FIG.14.
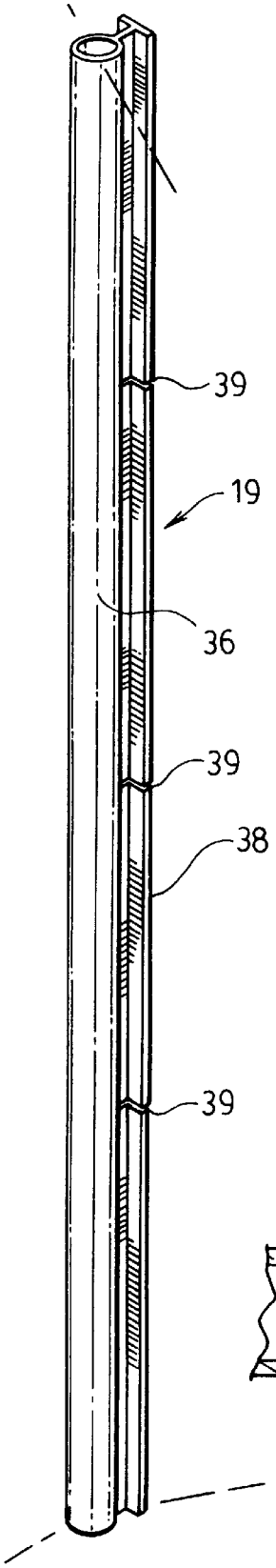
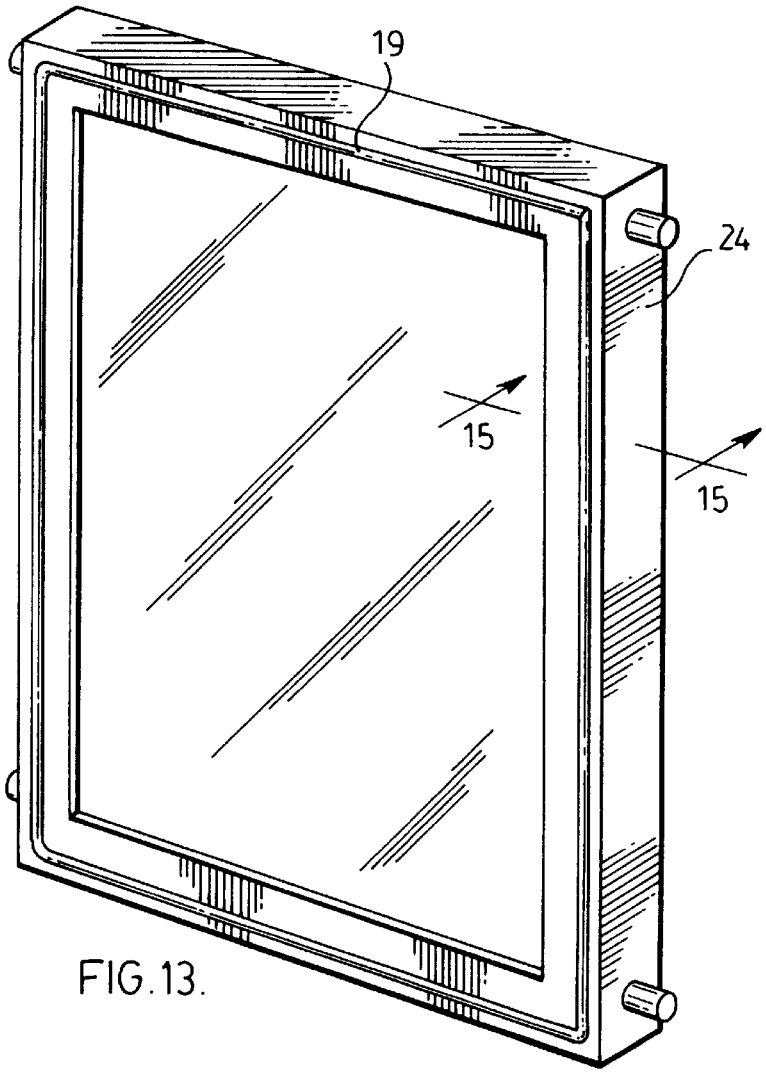
FIG.13.
FIG.15.
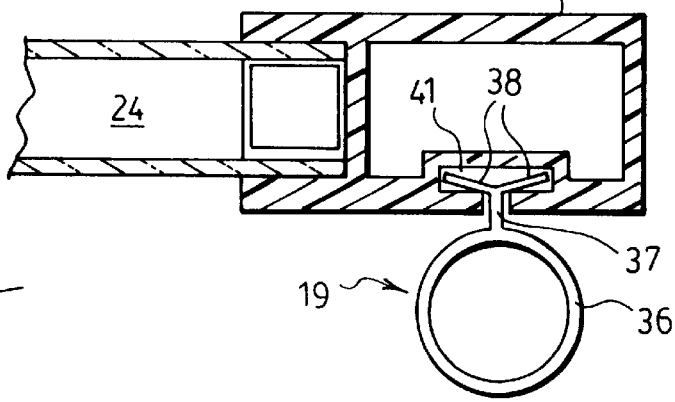

SLIDING WINDOW SEAL

FIELD OF THE INVENTION

This invention relates to windows which slide including windows which slide and tilt or swing open and, more particularly, to the provision in a very simple manner of achieving of a greatly improved weather seal on closing the window.

BACKGROUND OF THE INVENTION

Conventional window units incorporating a sliding window or sash employ weather stripping which extends around the sash when it is closed to provide a window seal. Such weather stripping can be mounted on the frame of the sash or on the window frame in which the sash slides or on both the sash and window frame and is compressed between the sash and window frame to effect the window seal.

Manipulation of the sash on opening and closing the window subjects such weather stripping to frictional wear and tear. As a result, such exposure to frictional abrasion limits the nature of the weather stripping which can be used to solid type strips with limited compressibility or spreadability thereby limiting the effectiveness of the window seal. The effectiveness of this seal in turn decreases with the frictional wear and tear under continued usage.

U.S. Pat. No. 4,704,821, issued Nov. 10th, 1987, discloses a floating slideable lower sash attached to a complex balance arrangement which is actuated to displace the bottom edge of the sash laterally against weather stripping as it reaches the closed position. However, such special arrangement is expensive and does not provide a uniform seal around the sash by simple closing of the sash. Further, such arrangement does not positively preclude frictional wear of the weather stripping on manipulation of the sash.

SUMMARY OF THE INVENTION

This invention resides in providing a very simple arrangement whereby the slideable sash of a window unit is moved laterally at the point of closure by the act of closing to uniformally compress weather stripping used to seal the window around the sash without subjecting such weather stripping to damaging frictional stress.

It will be understood that with this arrangement in which the weather stripping is simply subjected to compressive forces the invention enables the use of softer weather stripping such as bubble type sealing strips and the like which give a wider area of seal on compression.

In its broadest aspect the invention resides in providing cooperating means between opposite ends of the slideable sash and the frame in which it slides to move the sash laterally as it is closed to compress the sash window sealing weather stripping between the sash and frame. The invention further contemplates the positive retraction of the sash from its weather stripping compression position on raising of the sash.

According to one embodiment of the invention, the lateral movement of the sash is effected by members attached to the sash projecting into recessed trackways with slotted entrances provided in the frame in which the sash slides, such trackways and slots being formed to act on the sash members to simultaneously cam both ends of the sash laterally at the point of sash closing to effect the uniform window seal.

Again in this embodiment of the invention, such sash members and recessed trackways with their slotted entrances are arranged for cooperative action to positively retract the sash laterally from its weather stripping compressing position and eliminate frictional wear on the weather stripping as the sash is raised.

Again, according to a preferred embodiment of the invention, there is provided a slideable sash as aforesaid which is also tiltable or swingable.

In this connection, according to one embodiment of the invention, the members attached to the sash which ride in the frame trackways comprise shoes to which one end of said sash is pivoted, and tilt or swing locks mounted at the opposite end of said sash and having locking bolts projectable into the slotted entrances of the trackways shaped to provide the required lateral sash movement on closing.

In another embodiment of the invention, the sash is provided at each end with projecting pins which ride in the frame trackways or slots, the pins at one end of the sash preferably being retractable for sash swinging or tilting and/or removal.

Again, in utilizing the interaction between members carried by the slideable sash and the trackways provided in the frame in which the sash slides according to the invention, conventional balances may be employed for vertically slideable and/or vertically slideable and tiltable sashes.

These and other features of the invention will be apparent from the following detailed description taken in conjunction with the accompanying drawings.

BRIEF DESCRIPTION OF THE DRAWINGS

FIG. 9 is a part diagrammatic top plan view illustrating the sash shown in FIG. 8 in the latterly shifted closed weather stripping compressing position.

FIG. 10 is a view similar to FIG. 9 but showing the sash open with the weather stripping in the uncompressed state.

FIG. 11 is a broken away perspective view showing one of the retractable pins at one end of the sash.

FIG. 12 is a broken away sectional view showing the retractable pin of FIG. 11 locked in its projecting position.

FIG. 13 is a perspective view of the horizontally slideable sash.

FIG. 14 is a perspective view of a preferred bubble type weather stripping.

FIG. 15 is a cross section on line 15—15 of FIG. 13 showing the bubble weather stripping attached to the sash.

DETAILED DESCRIPTION ACCORDING TO THE PREFERRED EMBODIMENTS OF THE PRESENT INVENTION

Figure 1:
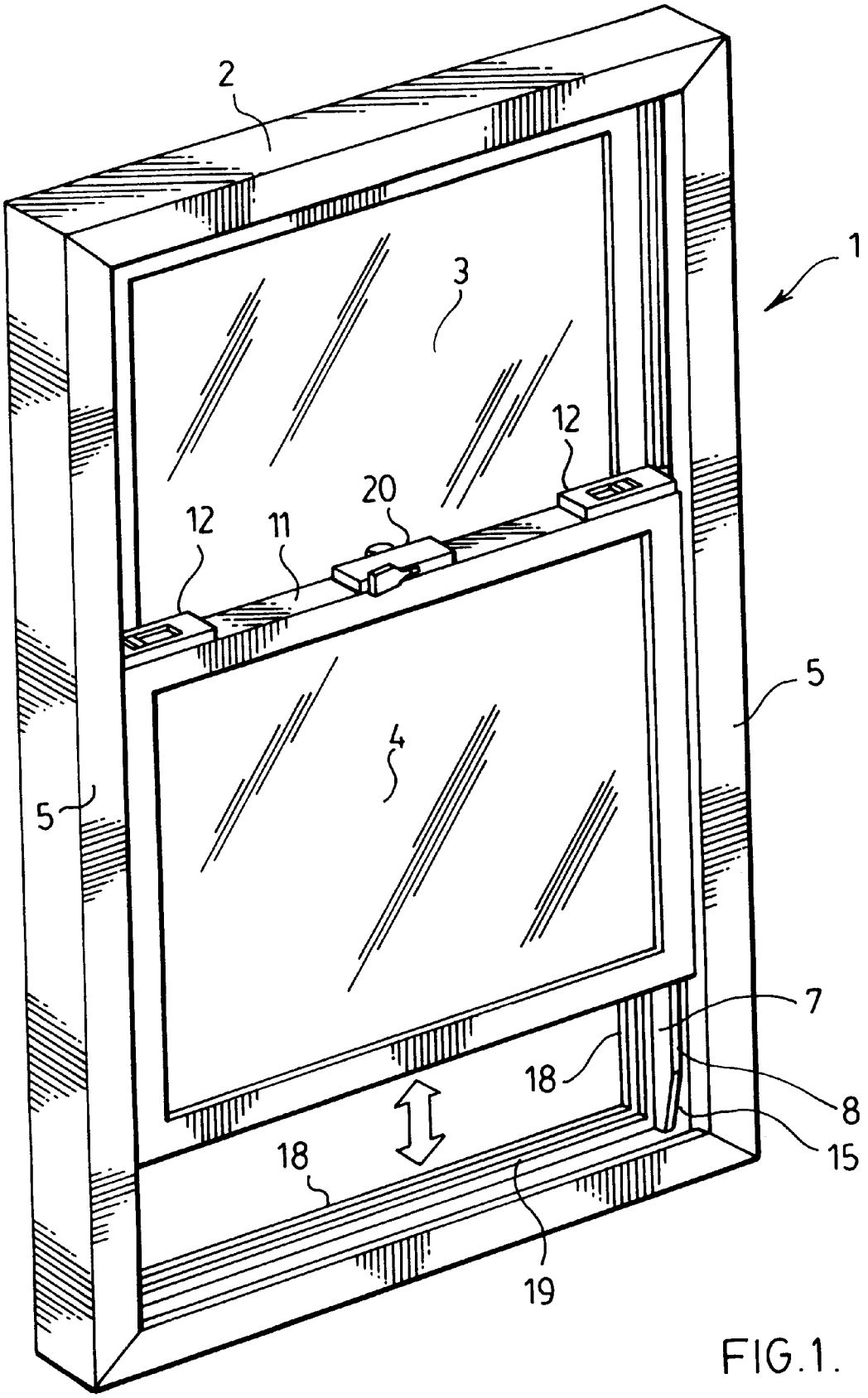
FIG. 1 is a perspective view of a single hung window unit having a slideable and tiltable lower sash provided with cooperating means with the recessed window frame trackways and their slotted entrances to effect lateral movement as the window is closed in accordance with the invention.

In the embodiment of the invention shown in FIG. 1, the window unit generally designated at 1 comprises a rectangular frame 2 having a fixed upper sash 3 mounted therein and a slideable and tiltable lower sash 4 slideable therein. The frame 2 and the frames of the sashes 3 and 4 are preferably plastic but may also, for example, be formed of aluminum as will be appreciated.

The sides or jambs 5 of the frame which are identical, one only being shown, are provided with recessed trackways 6 (see FIG. 3) behind a planar slotted bearing surface 7 on which the lower sash 4 slides.

The slot 8 in each of the bearing surfaces 7 providing entrance to the respective recessed trackway 6 has a particular configuration as shown in FIGS. 3, 3A, 4 and 5 for a purpose as hereinafter explained.

Figure 2:
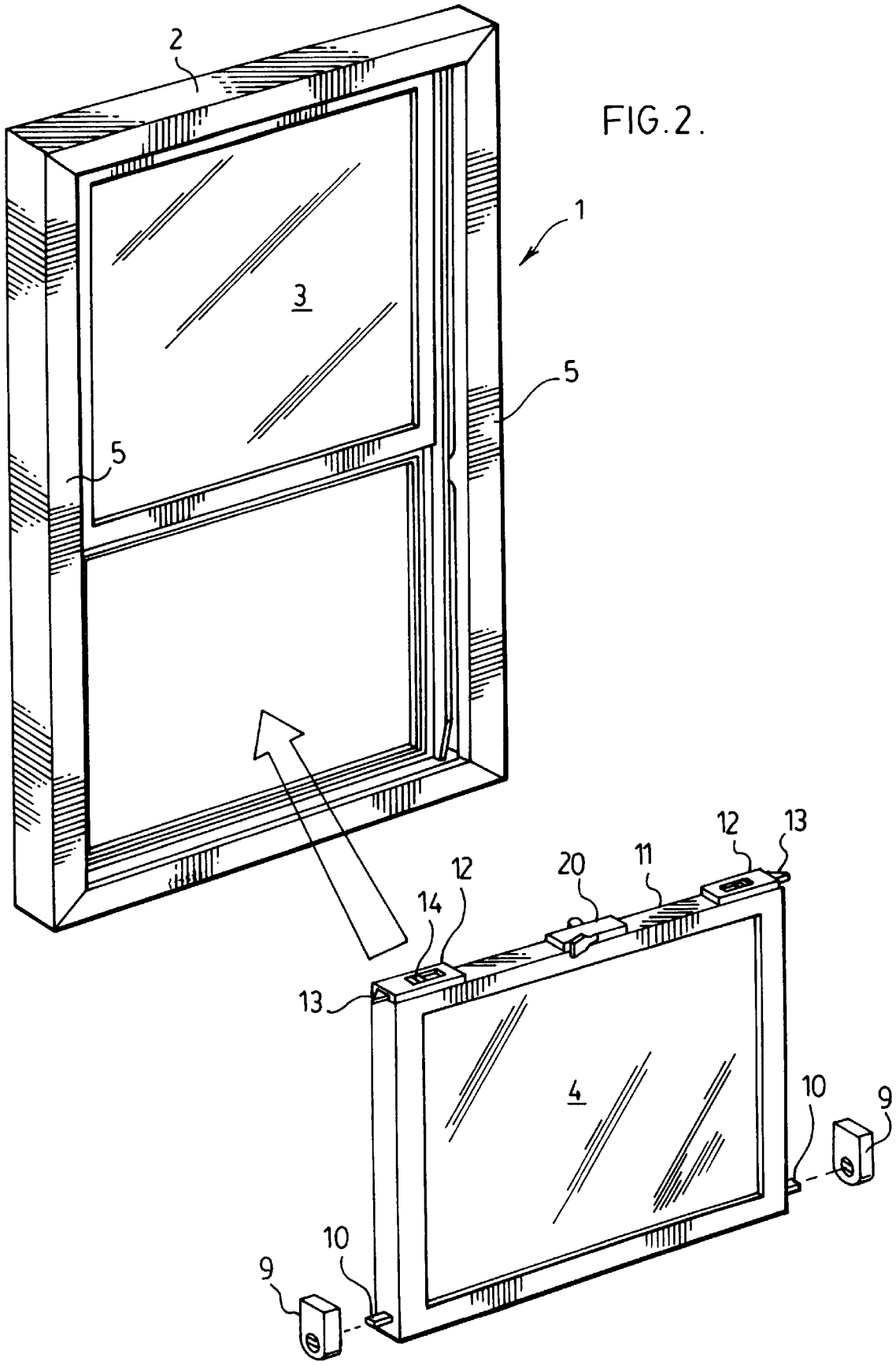
FIG. 2 is a view of the window unit of FIG. 1 with the lower sash removed.
Figure 3:
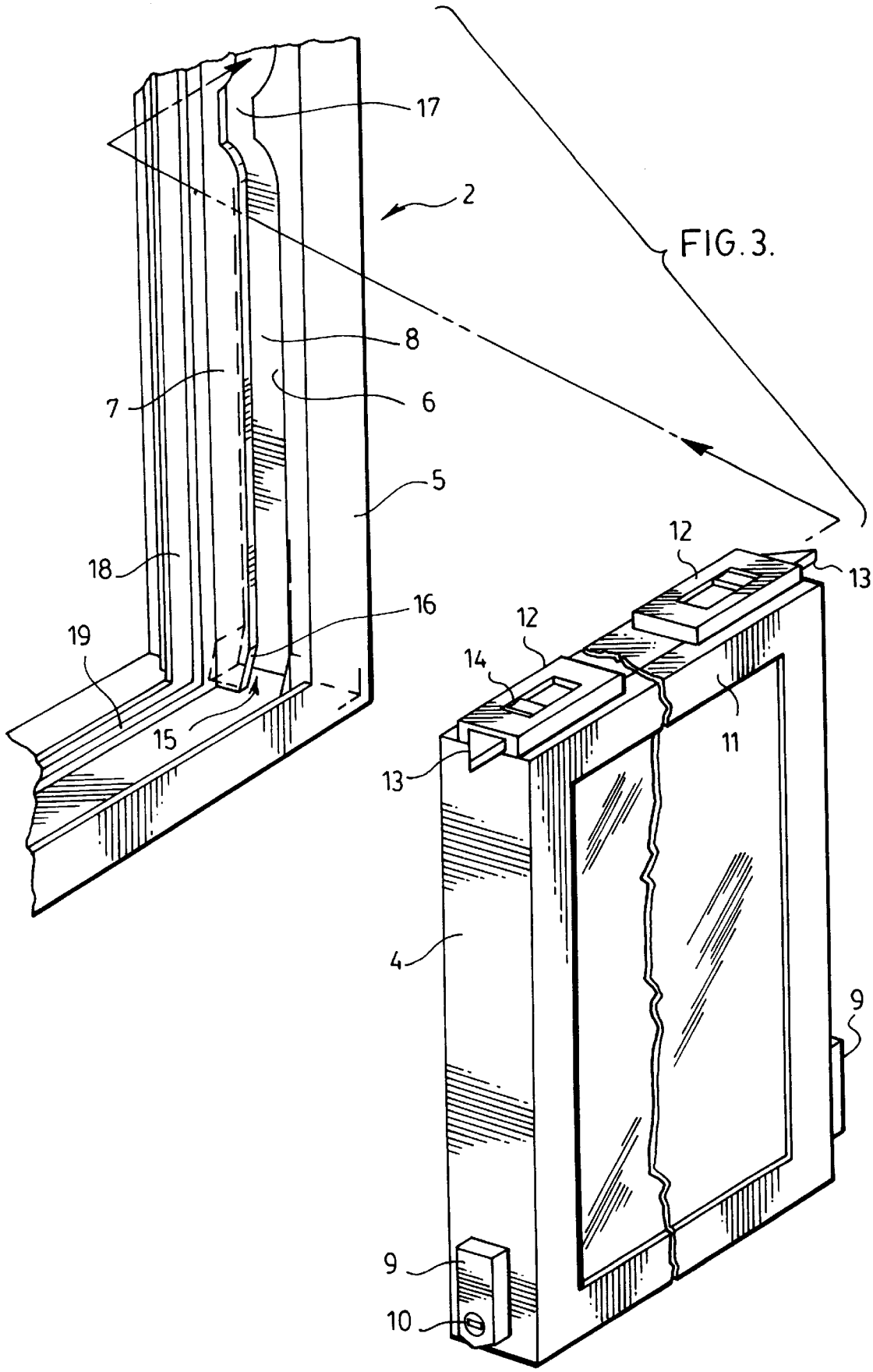
FIG. 3 is a fragmented enlarged perspective view illustrating one of the trackways formed as a molding to provide a configuration to cooperate with the means carried by the lower sash for effecting lateral sash movement at the point of sash closing and opening.

As shown particularly in FIGS. 2 and 3, the lower sash 4 is pivotally connected to shoes 9 which are adapted to slide in the recessed trackways 6 with the pivotal connections 10 projecting through the slots 8 in the frame bearing surfaces 7.

Mounted on the top or header 11 of the lower sash at each side thereof are tilt locks 12 whose bolts 13 can be projected or retracted by a finger operator 14.

When extended the bolts 13 extend into the trackways 6 through the slots 8 with their engagement with the slot 8 guiding the upper end of the lower sash 4 while the shoes 9 operating in the trackways 6 guide the lower end of the lower sash during its sliding movement.

On retraction of the bolts 13, the lower sash is free to tilt on its pivots 10 while its lower end is held in the frame 2 by the shoes 9 retained in the recessed trackways 6.

It will be understood that the window unit will be provided with a conventional balance arrangement (not shown) which may be conveniently attached to the shoes 9 to counterbalance the weight of the lower sash.

Figure 4:
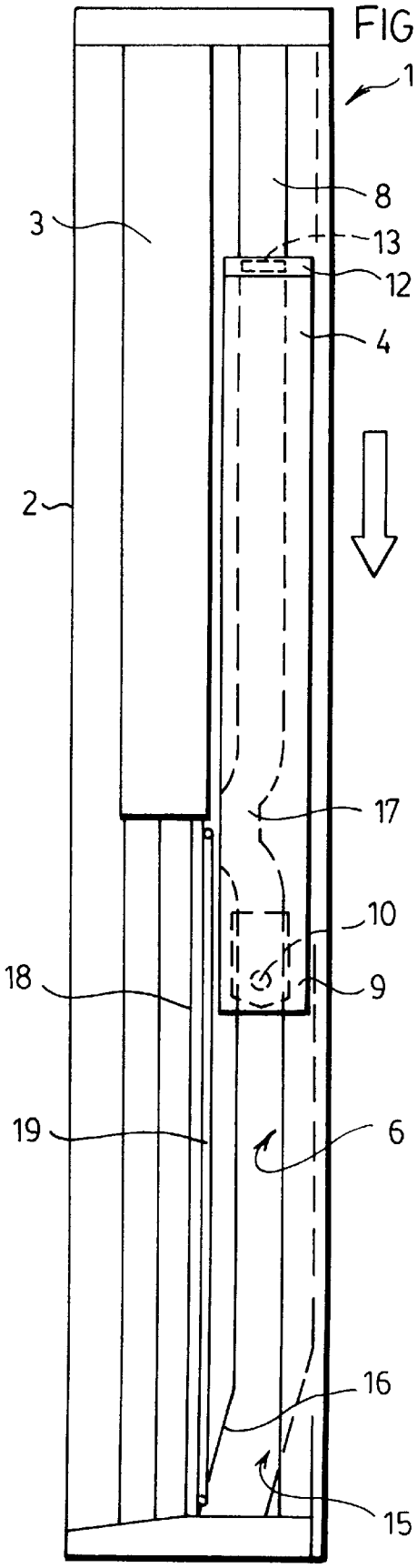
FIG. 4 is a diagrammatic elevational view illustrating the lower sash in a partially closed position showing the clearance between the sash and the weather stripping which is mounted on the frame.
Figure 5:
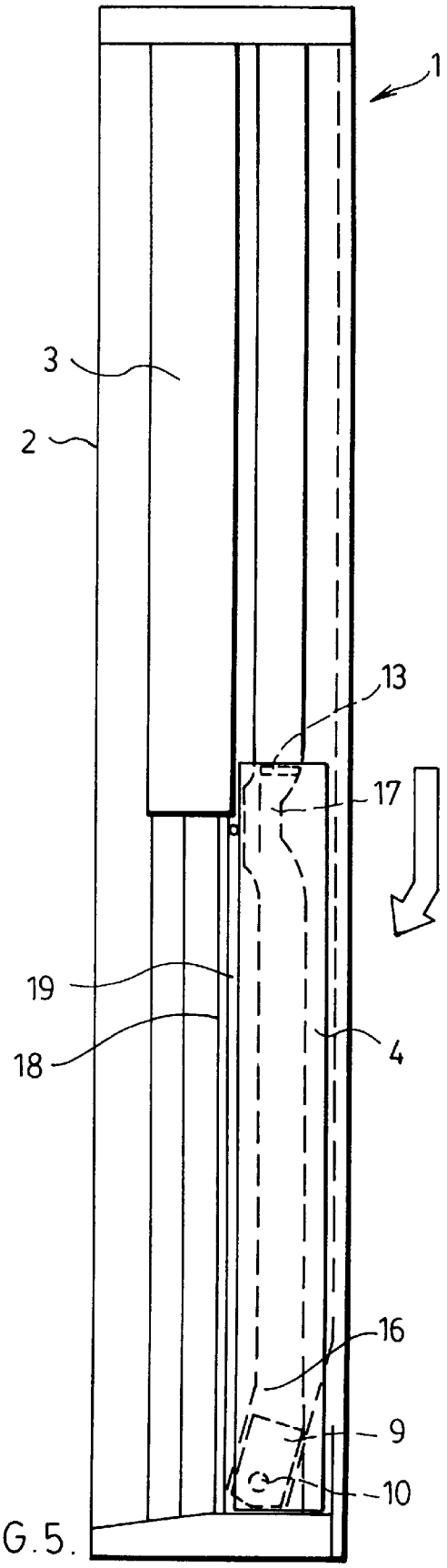
FIG. 5 is a view similar to FIG. 4 but showing the lower sash in the laterally shifted closed weather stripping compressing position.
Figure 6:
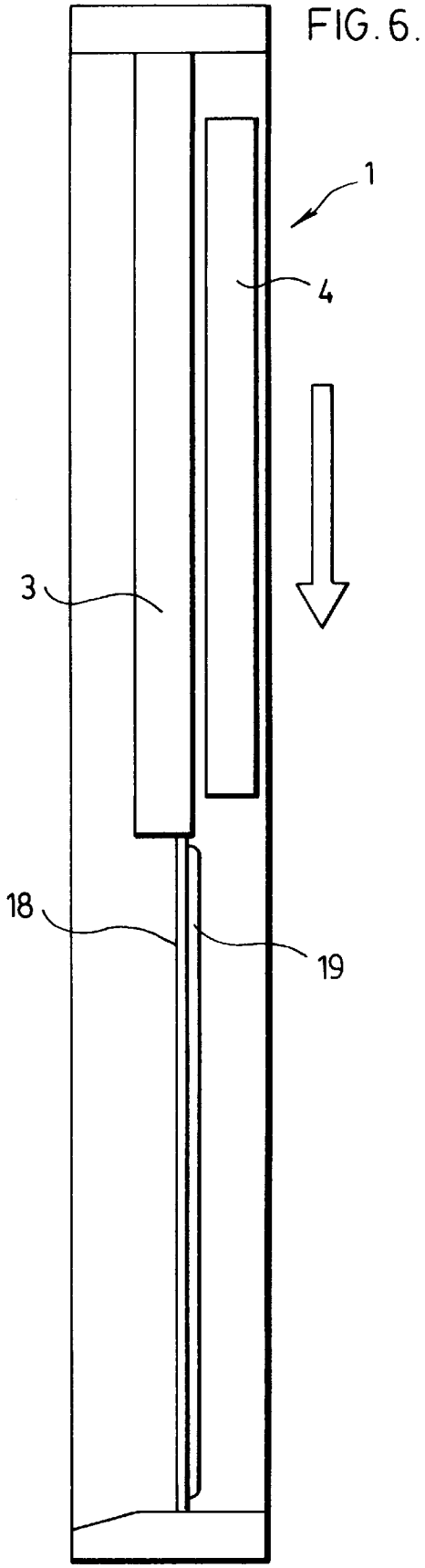
FIG. 6 is an elevational diagram to illustrate the clearance between the lower sash and the upper sash when the lower sash is in the raised position and showing the weather stripping mounted on the frame in the uncompressed state.
Figure 6A:
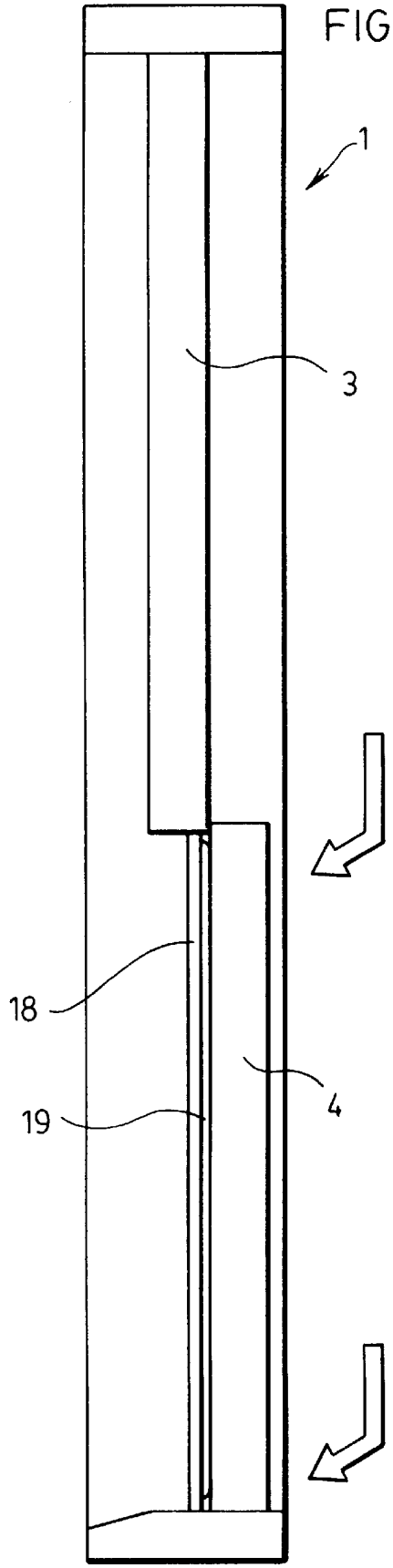
FIG. 6A is a view similar to FIG. 6 but showing the lateral displacement of the lower sash on being closed to compress the weather stripping.

As shown particularly in FIGS. 3, 4 and 5, the recessed trackway 6 is sloped inwardly at the bottom thereof as indicated at 15 so that as the shoe 9 reaches the lower sash closed position it is forced laterally inwardly to move the lower end of the sash inwardly. To accommodate this movement the slot 8 is also sloped inwardly as at 16. The slot 8 is again sloped inwardly as at 17 adjacent the bottom of the upper sash 3 so that the bolt 13 riding in the slot 8 is cammed inwardly by the slot portion 17 as the sash is closed. This action of course takes place at both sides of frame 2.

Thus, as the sash 4 is closed, both the lower and upper ends of the sash are simultaneously cammed or guided inwardly toward the frame 2.

The frame 2 is provided with a peripheral planar stop surface 18 facing the lower sash 4 around the perimeter of its frame when the lower sash is closed. In the embodiment illustrated in FIGS. 3 to 6A, the weather stripping or sealing strips 19 employed to seal window while in the closed position are shown mounted on the stop 18, the arrangement being such that as the lower sash is cammed inwardly both at the bottom and top by the act of closing the sash, the weather stripping 19 is compressed between the frame of the sash and the stop surface 18 to provide a uniform compression seal around the lower sash at the closed position.

As the lower sash 4 is raised, the shoes 9 are cammed or guided outwardly away from the weather stripping 19 by virtue of the sloped surface 15 of the trackways 6 and the bolts 13 are simultaneously cammed or guided outwardly by the sloping slot portion 17. Thus this lower sash 4 is moved outwardly clear of the weather stripping to release it from its compressed state and out of contact with the sash as it moves away from the closed position.

Since the weather stripping 19 is not subjected to any destructive frictional stresses under the sliding movement of the sash 4, softer or more pliable weather stripping such as the bubble type weather stripping illustrated particularly in FIG. 14 can be employed. Such weather stripping when compressed provides a wider area of seal and hence a more effective seal because of its greater deformability or spreadability.

Figure 7:
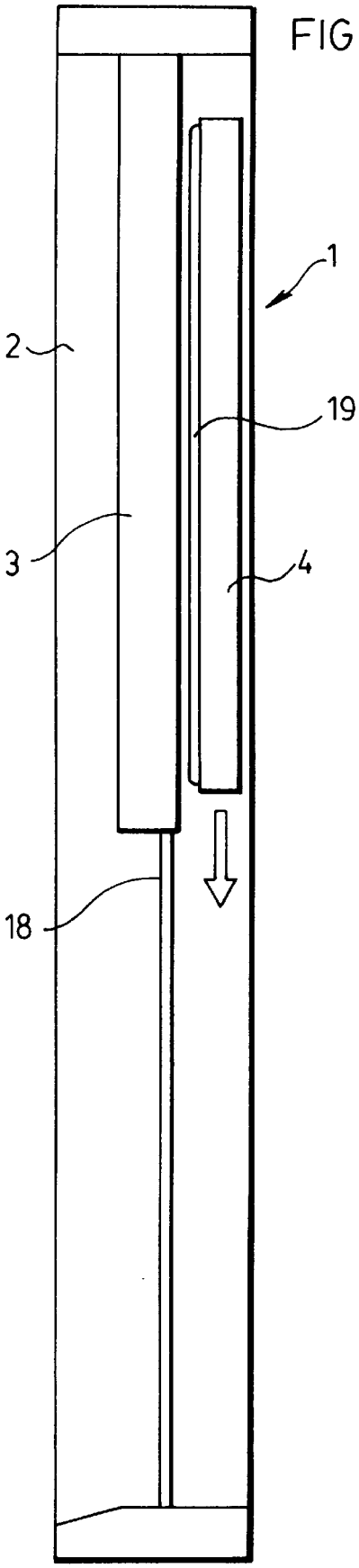
FIG. 7 is a view similar to FIG. 6 but showing the weather stripping mounted on the sash.
Figure 7A:
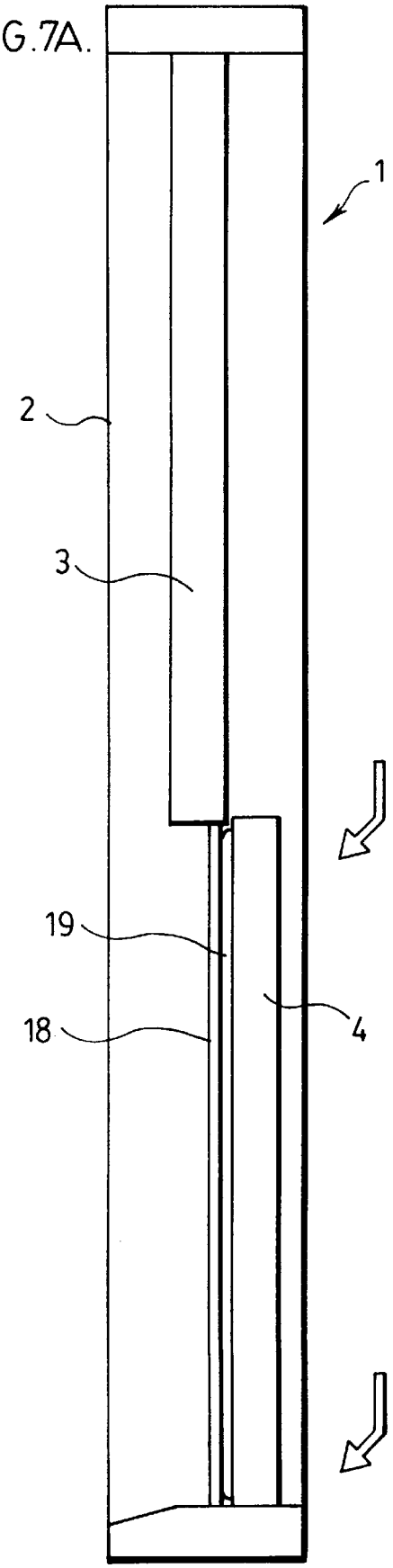
FIG. 7A is a view similar to FIG. 6A but showing the weather stripping mounted on the sash.

While the weather stripping 19 in the embodiment of the invention illustrated in FIGS. 3 to 6 is mounted on the stop surface 18 of the frame, it will be understood that it can equally as well be mounted to extend around the frame of the lower sash 4 itself as illustrated in FIGS. 7 and 7A. As illustrated in FIGS. 7 and 7A, the weather stripping 19 is again uniformly compressed between the frame stop surface 18 and the frame of the sash 4 by the action of closing the lower sash.

It will be understood that the operation of the sash 4 in the diagrammatic FIGS. 7 and 7A will be the same as shown in FIGS. 3, 4 and 5 and thus the compressive forces on the weather stripping 19 are automatically released by the opening movement of the sash which is retracted outwardly by the interengagement between the shoes 9 operating in the trackways 6 and the release of the bolts 13 from their inward cammed position to which they have been displaced by the sloping slot portions 17.

Away from the closed position, the sash 4 is held spaced from the frame stop surface 18 and the upper sash 3 by the shoes 8 riding in the trackways 6 and the bolts 13 riding in the slots 8 so that the weather stripping 19 is free of any frictional wear or tear.

To lock the window unit the lower sash 4 is provided with a conventional window lock 20 for cooperation with a suitable catch (not shown) provided on the upper sash 3.

The sides of the frame 2 presenting the recessed trackways 6 with their entrance slots 7 can conveniently be formed to have the appropriate shapes as compression molded plastic members as shown in FIG. 3. Corresponding recessed trackway 6' with slotted entrances 8' may also be provided in extruded frame members (i.e. of plastic or aluminum) with the use of cam inserts as shown in FIG. 3A.

Figure 3A:
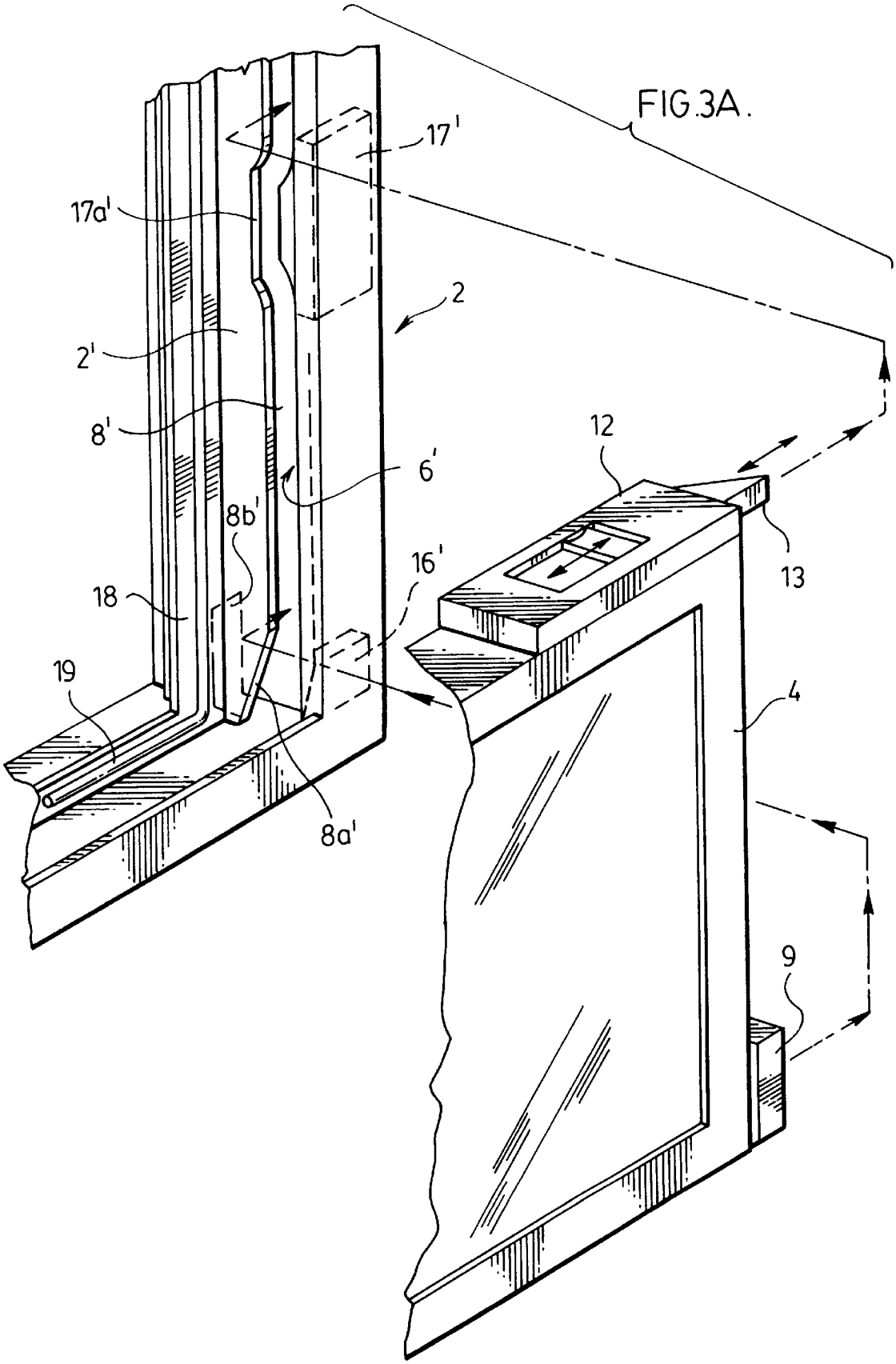
FIG. 3A is a view similar to FIG. 3 but showing the trackway as a notched extrusion in which cams are mounted for effecting lateral sash movement.

With reference to FIG. 3A, the extrusion designated at 2' of the frame 2 is formed with the recessed trackway 6' and the slot 8' providing the entrance thereto.

Mounted in the trackway 6' at the bottom thereof is a cam 16' arranged to displace the respective sash shoe 9 laterally as the sash closes. The edge of the slot 8' opposite the cam 16' is cut away at 8'*a* and notched at 8'*b* opposite the cam 16' as shown to permit lateral shoe and sash movement. Similarly, in place of the slot shaped trackway 6 and slot portion 17 shown in FIG. 3 to cam the upper end of the sash 4 inwardly FIG. 3A shows cam 17' mounted in the trackway 6'. The slot 8' is then cut away at 17'*a* opposite the cam 17' to accommodate the lateral inward movement and retraction of the sash as the window moves between the closed and positions.

Figure 8:
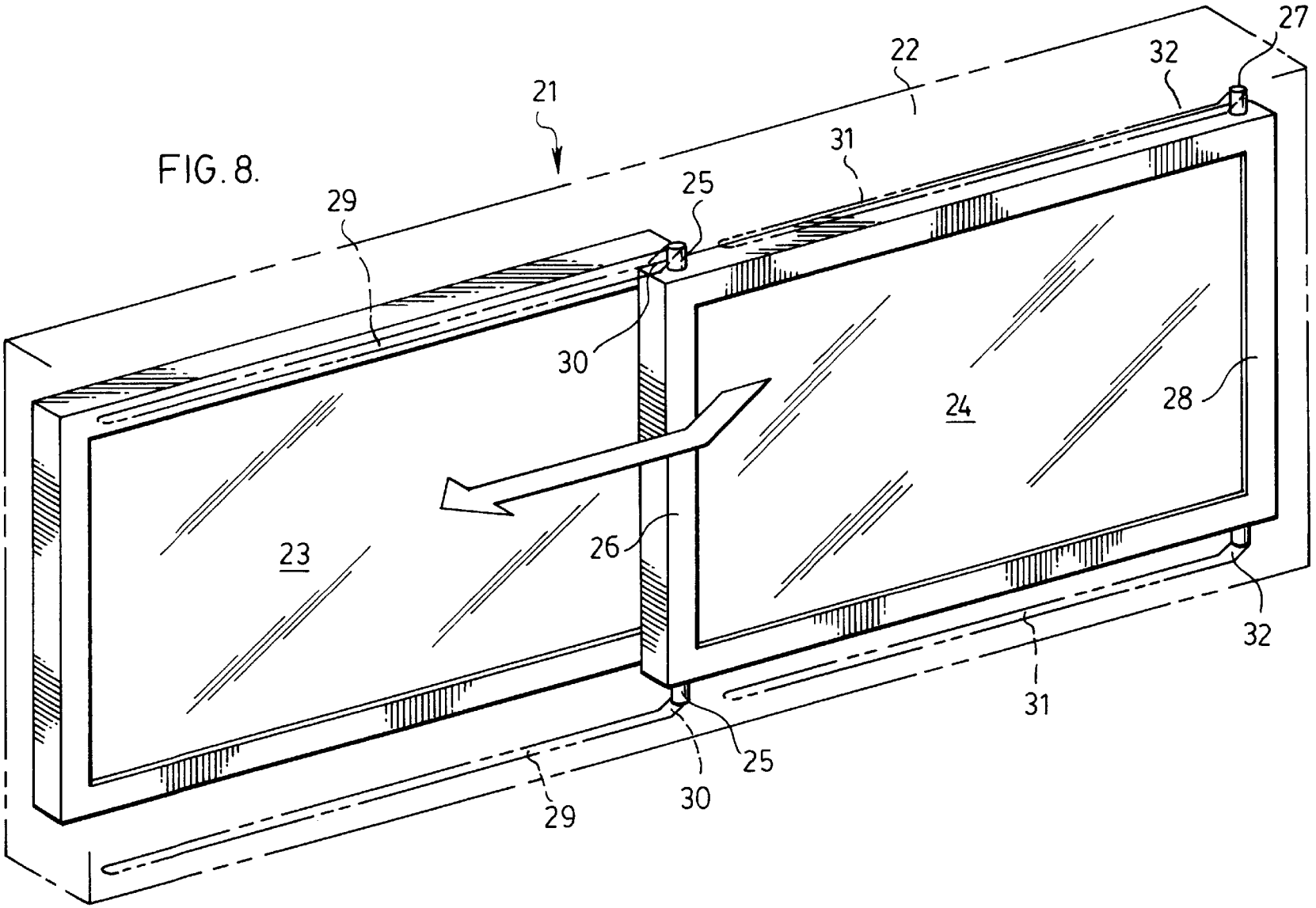
FIG. 8 is a part diagrammatic perspective view illustrating the application of the invention to a horizontally slideable sash.

It will be understood that the invention is also applicable to horizontally slideable windows as illustrated in FIGS. 8, 9 and 10 where the window unit 21 has a horizontal frame 22, a fixed sash 23 and a slideable sash 24 which may also be swingable or "tiltable" to swing open to provide access to clean the glass.

The slideable sash 24 is provided at each end with projecting pins with the pins being designated at 25 at the inner end 26 and the pins being designated at 27 at the outer end 28.

The pins 25 ride in slots 29 provided in the frame 22 with the inner ends 30 of these slots being turned inwardly towards the frame 22.

Similarly, the pins 27 carried by the outer end 28 of the sash ride in slots 31 provided in the frame 22 with the outer ends 32 of the slots 31 being turned inwardly of the frame 22.

As shown in FIGS. 9, 10 and 13, the sash 24 is provided around the perimeter of its frame with weather stripping 19 so that when the sash 24 is moved to the closed position it is moved laterally inwardly to compress the weather stripping 19 against a perimeteral stop surface (not shown) which it will be understood will correspond to the stop surface 18 shown particularly in FIG. 3.

As illustrated in FIG. 10, as the sash 24 is moved to the open position, the pins 25 and 27 riding in the slots 29 and 31 cam the slideable sash outwardly so that the weather stripping 19 is retracted from its compressed state in FIG. 9 to its uncompressed state in FIG. 10 where it moves clear of frictional contact with the fixed sash 23.

As shown in FIGS. 11 and 12, the pins 27 at the outer end 28 of the slideable sash are shown as retractable against the action of a spring 34 urging the pin 27 outwardly where it may be locked by a locking member or pin 35. With the pins 27 retracted, the sash 24 can then be swung outwardly pivoting on the pins 25.

The weather stripping 19 is particularly illustrated in FIG. 14 and comprises a sleeve or bubble portion 36 of flexible material connected by a leg 37 to a pair of feet 38.

To provide a continuous length of weather stripping around the slideable sash, as illustrated in FIG. 13 a length of the weather stripping 19 is cut at appropriate lengths as indicated at 39 so that it can be folded around the frame members 40 of the sash until opposite ends abut where they can be joined by welding to form a continuous peripheral strip of weather stripping.

FIG. 15 which is a cross section along the line 15—15 of FIG. 13 shows one of the frame members 40 of the slideable sash 24 as a hollow extrusion provided with an undercut channel 41 to receive the feet 38 of the weather stripping 19 to secure same in position on the sash.

The bubble type weather stripping 19 illustrated provides an excellent seal because under compression it collapses to provide a wide sealing area while giving excellent recovery when the compressive forces are removed. It will be understood, however, that other forms of weather stripping may be used so that long as they retain adequate sealing capacity under repeated compressions.

Although various preferred embodiments of the present invention have been described herein in detail, it will be appreciated by those skilled in the art, that variations may be made thereto without departing from the scope of the appended claims.

The embodiment of the invention in which an exclusive property or privilege is claimed are defined as follows:

1. A window unit comprising a window frame and a sash having a frame slideable in said window frame between closed and open positions, said window frame presenting a peripheral planar stop surface facing said sash frame around its perimeter blocking outward movement of said sash in the closed position and having guideways at each side thereof extending in the direction in which said sash slides, guideway engaging means attached to opposite sides of said sash at opposite ends thereof engaging in said guideways, a sealing material mounted on at least one of said window frame stop surface and said sash frame to extend therearound, said guideways being configured to simultaneously displace said guideway engaging means at opposite ends of said sash laterally of the direction of sash slide as the sash is closed to cause movement of the sash laterally of its direction of slide compressing said sealing material between said frame stop surface and said sash frame to provide a compression seal around said sash frame solely as a result of sliding the sash.

2. A window unit comprising a window frame and a slideable sash having a frame slideable in said window frame between closed and open positions, said window frame having a peripheral stop surface blocking outward movement of said sash when said sash is in the closed position, said window frame having at each side thereof in the direction of sash sliding movement a continuous recessed trackway provided with a continuous entrance slot narrower than said trackway leading thereto, said sash frame having a shoe pivotally connected to each side thereof adjacent one end thereof, said shoes being slideably received in said recessed trackways, means carried by said sash frame adjacent the opposite end thereof for engagement with said entrance slots, sealing material mounted on at least one of said window frame stop surface and said sash frame, such that weather stripping surrounds said sash frame when said sash is closed, said trackways and said entrance slots being formed to displace said shoes and said slot engagement means respectively laterally of the direction of sash slide as the sash is closed to move the sash laterally of its direction of slide to compress said sealing material between said window frame stop surface and said sash frame to provide a compression seal around said sash frame.

3. A window unit as claimed in claim 2 in which said sash is vertically slideable.

4. A window unit as claimed in claim 2 in which said sash is horizontally slideable.

5. A window unit as claimed in claims 2, 3 or 4 in which said slot engaging means carried by said sash frame comprise lock members having retractable bolts adapted to be moved into and out of said entrance slots to respectively lock and unlock said sash against pivotal movement about said pivotally connected shoes.

6. A window unit comprising a window frame and a vertically slideable sash slideable in said frame between closed and open positions, said frame presenting a peripheral stop surface facing said sash and blocking outward movement of said sash when said sash is in the closed position, said window frame having at each side thereof a continuous recessed vertical trackway provided with an entrance slot narrower than said trackway leading thereto, said sash having a shoe pivotally connected to each side thereof adjacent the bottom thereof, said shoes being slideably received in said trackways, means carried by said sash adjacent the upper end thereof for engagement with said entrance slots, sealing material mounted on at least one of said window frame stop surface, and said sash, such that weather stripping surrounds said sash when said sash is closed, said trackways and entrance slots being formed to respectively simultaneously displace said shoes and said slot engaging means laterally of the direction of slide towards said window frame stop surface as the sash is closed to move the sash at the bottom and top towards said window frame stop surface to compress said sealing material between said frame stop surface and said sash to provide a compression seal around said sash solely as the result of sliding the sash to the closed position.

7. A window unit as claimed in claim 6 in which said slot engaging means carried by the upper end of said sash comprises a lock mounted on the upper end of said sash at each side thereof, said locks having retractable bolts adapted to be moved into and out of said slots to lock and unlock respectively said sash against pivotal tilting movement about said pivotal shoe connections.

8. A window unit as claimed in claim 6 or 7 in which said trackways are diverted laterally towards said frame stop at their lower ends to displace said shoes laterally as the sash is closed and said entrance slots are diverted laterally towards said frame stop adjacent the point the upper end of said sash reaches the closed position.

9. A window unit as claimed in claim 2 or 6 in which at least the portions of said window frame incorporating said recessed trackways with entrance slots are formed of molded plastic.

10. A window unit as claimed in claims 2 or 6 in which at least the portions of said window frame incorporating said recessed trackways with entrance slots are formed as plastic extrusions and have guide members mounted therein to guide said shoes as the sash is closed.

11. A window unit as claimed in claim 2 or 6 in which said weather stripping is bubble material.

* * * * *